US008293343B2

(12) United States Patent
Nakano

(10) Patent No.: US 8,293,343 B2
(45) Date of Patent: Oct. 23, 2012

(54) INKJET RECORDING MEDIUM

(75) Inventor: Ryoichi Nakano, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 479 days.

(21) Appl. No.: 12/607,087

(22) Filed: Oct. 28, 2009

(65) Prior Publication Data

US 2010/0112245 A1 May 6, 2010

(30) Foreign Application Priority Data

Nov. 5, 2008 (JP) ..... 2008-284072

(51) Int. Cl.
*B41M 5/00* (2006.01)

(52) U.S. Cl. ..... 428/32.21; 428/32.26; 428/32.27; 428/32.28; 428/32.29; 428/32.3; 428/32.34

(58) Field of Classification Search ..... 428/32.21, 428/32.26, 32.27, 32.28, 32.29, 32.3, 32.34
See application file for complete search history.

(56) References Cited

U.S. PATENT DOCUMENTS

| | | | | |
|---|---|---|---|---|
| 2005/0003112 | A1* | 1/2005 | Chen | 428/32.11 |
| 2006/0019042 | A1* | 1/2006 | Nojima et al. | 428/32.24 |

FOREIGN PATENT DOCUMENTS

| | | | |
|---|---|---|---|
| JP | 11-138978 | A | 5/1999 |
| JP | 11-286163 | A | 10/1999 |
| JP | 2002-036716 | A | 2/2002 |
| JP | 2003-019859 | A | 1/2003 |
| JP | 2003-159869 | A | 6/2003 |
| JP | 2003-326832 | A | 11/2003 |
| JP | 2004-181760 | A | 7/2004 |

* cited by examiner

*Primary Examiner* — Betelhem Shewareged
(74) *Attorney, Agent, or Firm* — SOLARIS Intellectual Property Group, PLLC

(57) ABSTRACT

An inkjet recording medium having a substrate and, on or above the substrate, an ink-receiving layer is disclosed. The ink-receiving layer contains at least one type of inorganic fine particles, at least one water-soluble resin, and at least one ethylene oxide adduct of an acetylene glycol compound having an HLB value of 6 or less.

13 Claims, No Drawings

INKJET RECORDING MEDIUM

CROSS-REFERENCE TO RELATED APPLICATION

This application is based on and claims priority under 35 USC 119 from Japanese Patent Application No. 2008-284072 filed on Nov. 5, 2008, the disclosure of which is incorporated by reference herein.

BACKGROUND OF THE INVENTION

1. Field of the Invention

The present invention relates to an inkjet recording medium.

2. Description of the Related Art

With the improvement in resolution of images printed by recent inkjet printers, it has become possible to obtain recorded matter of photograph-like high quality, and with this evolution of the hardware (apparatus), various kinds of media for inkjet recording have been developed.

Properties required of recording sheets for inkjet recording generally include (1) a property of drying quickly (having a high ink absorption speed), (2) a property of ensuring ink dots of a correct and uniform diameter (being free of bleeding), (3) a property of ensuring good graininess, (4) a property of ensuring ink dots of high roundness, (5) a property of ensuring high color density, (6) a property of ensuring high color saturation (no dullness), (7) a property of ensuring high resistance to water, light and ozone in a printed portion, (8) a property of having a high degree of whiteness in the background portion, (9) a property of having good storability (a property of causing neither yellow coloration even over long-term storage nor bleeding of images by long-term storage (bleeding with aging)), (10) a property of having high resistance to deformation and good dimensional stability (having sufficiently limited curling), and (11) a property of ensuring smooth running in an apparatus.

When recording sheets are used as glazed photo paper for the purpose of obtaining photograph-like high-quality recorded matter, they are further required to have glossiness, surface smoothness and texture resembling that of photographic printing paper for silver-salt photographs, in addition to the properties recited above.

For the purpose of improving these properties, inkjet recording media having porous structures in their respective ink-receiving layers have been developed and put to practical use in recent years. Such inkjet recording media may have excellent ink receptivity (quick-dry properties) and high glossiness owing to their porous structures.

For example, inkjet recording media having, on or above a substrate, an ink-receiving layer containing fine particles of an inorganic pigment, a water-soluble resin, a multivalent metal salt, and an acetyleneglycol compound have been proposed (see, for example, JP-A No. 2003-326832). JP-A No. 2003-326832 discloses that these inkjet recording media have excellent resistance to bleeding, do not cause coating problems, and further have excellent resistance to bleeding during storage after printing.

However, the inkjet recording papers disclosed in JP-A No. 2003-326832 do not satisfactorily suppress bleeding after printing, especially in a high humidity environment.

SUMMARY OF THE INVENTION

The present invention has been made in view of the above circumstances.

A first aspect of the invention provides an inkjet recording medium including a substrate and, provided on or above the substrate, an ink-receiving layer including at least one type of inorganic fine particles, at least one water-soluble resin, and at least one ethylene oxide adduct of an acetylene glycol compound having an HLB value of 6 or less.

According to the invention, it is possible to provide an inkjet recording medium whereby a high print density is obtained and occurrence of bleeding with aging (over time) is suppressed in a high humidity environment.

DETAILED DESCRIPTION OF THE INVENTION

Inkjet Recording Medium

The inkjet recording medium of the invention includes a substrate, provided on or above the substrate, an ink-receiving layer including at least one type of inorganic fine particles, at least one water-soluble resin, and at least one ethylene oxide adduct of an acetylene glycol compound having an HLB value of 6 or less. Incorporation of such the specific compound having an HLB value of 6 or less in the ink-receiving layer enables to achieve, in combination, a high print density and suppression of bleeding with aging in a high humidity environment.

Ink-Receiving Layer

The ink-receiving layer used in the invention includes at least one type of inorganic fine particles, at least one water-soluble resin, and at least one ethylene oxide adduct of an acetylene glycol compound having an HLB value of 6 or less (hereinafter, also referred to as "specific surface active agent"), and if necessary may further include a crosslinking agent, a nitrogen-containing organic cationic polymer, a sulfur compound, a water-soluble multivalent metal salt, or other components.

Specific Surface Active Agent

The ink-receiving layer of the invention includes at least one ethylene oxide adduct of an acetylene glycol compound having an HLB value of 6 or less. By incorporating such the specific surface active agent having such the specific chemical constitution in the ink-receiving layer, bleeding with aging in a high humidity environment may be effectively suppressed, and further a high print density may be realized.

The ethylene oxide adduct of the acetylene glycol compound used in the invention is not particularly limited, as far as the compound has a constitution that is a product of addition of at least one ethylene oxide to an acetylene glycol compound having a carbon-carbon triple bond and two hydroxyl groups in the molecule thereof. Among these adducts, compounds represented by the following Formula (1) are preferable from viewpoints of bleeding with aging in a high humidity environment and print density.

Formula (1)

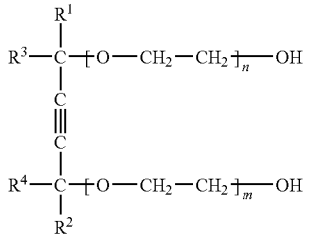

In Formula (1), $R^1$ and $R^2$ each independently represent an alkyl group having 1 to 20 carbon atoms. $R^3$ and $R^4$ each independently represent an alkyl group having 1 to 3 carbon atoms. m and n each independently represent an integer of 0 to 40, with the proviso that the total of m and n is 1 or more.

In the invention, it is preferable from the viewpoints of bleeding with aging in a high humidity environment and print density that $R^1$ and $R^2$ are each an isobutyl group (2-methylpropyl group) and $R^3$ and $R^4$ are each a methyl group, and a total of m and n is 1 or 2.

In the invention, the ethylene oxide adduct of the acetylene glycol compound has an HLB value of 6 or less, preferably from 2 to 6, and more preferably from 3 to 5. Here, the HLB value is a value that describes the hydrophilic-lipophilic balance of the compound. In the invention, with respect to compounds whose HLB value is known, the HLB value is represented by the known value. Further, with respect to compounds whose HLB value is not known, the HLB value is represented by a value calculated by the Davis method.

Further, when the ink-receiving layer used in the invention contains two or more ethylene oxide adducts of an acetylene glycol compound, a weighted average HLB value of each of the HLB values is defined as the HLB value in the invention.

A content of the specific surface active agent in the ink-receiving layer used in the invention is not particularly limited, as far as effects of the invention are not adversely affected by the specific surface active agent. From viewpoints of bleeding with aging in a high humidity environment and print density as well as wettability to the support, the content is preferably from 0.01 to 0.2 g/m$^2$, and more preferably from 0.03 to 0.15 g/m$^2$.

It is preferable that the ink-receiving layer used in the invention contains the ethylene oxide adduct of an acetylene glycol compound represented by Formula (1) in an amount of from 0.01 to 0.2 g/m$^2$ and the ethylene oxide adduct of the acetylene glycol compound has an HLB value of from 2 to 6. Further, it is more preferable that the ink-receiving layer used in the invention contains the ethylene oxide adduct of an acetylene glycol compound represented by Formula (1) in an amount of from 0.03 to 0.15 g/m$^2$ and the ethylene oxide adduct of the acetylene glycol compound has an HLB value of from 3 to 5. According to this constitution, it is possible to achieve more effectively in combination a higher print density and suppression of bleeding after printing in a high humidity environment.

Inorganic Fine Particles

The ink-receiving layer used in the invention contains at least one type of inorganic fine particles.

When the ink-receiving layer is formed, the inorganic fine particles form a porous structure and have a function of improving absorption properties of inks.

It is preferable that the solid content of the inorganic fine particles in the ink-receiving layer is 50% by mass or more and preferably more than 60% by mass, because such the content enables to create a better porous structure, thereby to contribute to formation of an inkjet recording medium with sufficient ink absorbency. Herein, the expression "solid content" of fine particles in the ink-receiving layer refers to the content calculated on the basis of all ingredients except for water in the composition for the ink-receiving layer.

Examples of inorganic fine particles for use in the invention include silica fine particles, colloidal silica, titanium dioxide, barium sulfate, calcium silicate, zeolite, kaolinite, hallosite, mica, talc, calcium carbonate, magnesium carbonate, calcium sulfate, pseudo-boehmite, zinc oxide, zinc hydroxide, alumina, aluminum silicate, calcium silicate, magnesium silicate, zirconium oxide, zirconium hydroxide, cerium oxide, lanthanum oxide and yttrium oxide. Of these substances, silica fine particles, colloidal silica, alumina fine particles and pseudo-boehmite are preferred over the others from the viewpoint of creating good porous structure. These fine particles may be used as they are primary particles, or in a state that they are formed into secondary particles. The average primary particle diameter of these fine particles is preferably 2 μm or less, and more preferably 200 nm or less.

Moreover, silica fine particles having an average primary particle diameter of 30 nm or less, colloidal silica having an average primary particle diameter of 30 nm or less, alumina fine particles having an average primary particle diameter of 20 nm or less and pseudo-boehmite having an average pore radius of 2 to 15 nm are more preferable, and silica fine particles, alumina fine particles and pseudo-boehmite in particular are favorably used.

Silica fine particles are usually roughly classified into wet method particles and dry method (vapor phase process) particles in accordance with the method of manufacturing thereof. In the mainstream of the wet method, silica fine particles are mainly produced by generating activated silica by acid decomposition of a silicate, appropriately polymerizing the activated silica, and aggregation-precipitating the resulting polymeric silica to obtain hydrated silica. On the other hand, in the mainstream of the gas phase process, silica (anhydrous silica) particles are produced by either a method of performing high-temperature gas-phase hydrolysis of a silicon halide (flame hydrolysis process), or a method of reductively heating silica sand and coke in an electric furnace with an arc discharge to vaporize silica and oxidizing the vaporized silica with air (arc method). The term "vapor-phase process silica" means a silica (an anhydrous silica fine particle) produced by the gas phase process. Vapor-phase process silica fine particles are particularly preferable as the silica fine particles used in the invention.

While the above vapor-phase process silica differs from hydrated silica in terms of the density of silanol groups on its surfaces, the presence or not of voids therein, and the like, and different properties are exhibited from each other, vapor-phase process silica is suitable for forming three-dimensional structures which have a high porosity. While the reason for this is not clearly understood, it can be supposed as follows. Namely, hydrated silica fine particles have a high density of silanol groups on the surface, at 5 to 8 per nm$^2$, thus the silica fine particles tend to aggregate densely. In contrast, vapor-phase-process silica particles have a lower density of silanol groups on the surface, at 2 to 3 per nm$^2$, thus vapor-phase process silica seems to form loose flocculation, consequently leading to structures with a higher porosity.

The vapor-phase process silica has a particularly large specific surface, high ink absorbency and retention, and a low refractive index. Therefore, the vapor-phase process silica has features such that it can impart transparency to the ink-receiving layer and ensure high color densities and good color forming capabilities as long as dispersion thereof is performed until it comes to have appropriate particle diameters. It is important for the ink-receiving layer to be transparent from the viewpoints of providing high color densities and good color-forming property and gloss in not only transparency-required uses, such as OHP, but also applications to recording media, such as a gloss photo paper.

An average primary particle diameter of the vapor-phase process silica particles is preferably 30 nm or less, more preferably 20 nm or less, particularly preferably 10 nm or less, and most preferably in a range of 3 to 10 nm. Since the vapor-phase process silica particles easily adhere to each other by hydrogen bonds due to the silanol groups, a structure having a high porosity can be formed thereby when the average primary particle size is 30 nm or less, whereby the ink absorption characteristic can be effectively improved.

The silica fine particles may be used in combination with other fine particles described above. When the other fine particles are used in combination with the vapor-phase silica, the amount of the vapor-phase silica relative to the total amount of fine particles is preferably 30% by mass or more, and more preferably 50% by mass or more Preferable examples of inorganic fine particles which can be used in the invention include alumina fine particles, alumina hydrate, and mixtures or complexes thereof. Among them, alumina hydrate is further preferable, as it absorbs and holds inks well. Pseudo-boehmite ($Al_2O_3.nH_2O$) is particularly preferable. Alumina hydrate may be used in a variety of forms. Alumina hydrate is preferably prepared by using boehmite in the sol state as the starting material, as it easily provides smoother layers.

With respect to the pore structure of pseudo-boehmite, an average pore radius thereof is preferably in a range of 1 to 30 nm and more preferably in a range of 2 to 15 nm. The pore volume thereof is preferably in a range of 0.3 to 2.0 ml/g, and more preferably in a range of 0.5 to 1.5 ml/g. The average pore radius and the pore volume are measured by the nitrogen absorption-desorption method. These values may be determined, for example, by using a gas absorption-desorption analyzer (e.g., trade name: OMNISORP 369, manufactured by Beckman Coulter, Inc.).

Of the alumina fine particles, the vapor-phase process alumina fine particles are preferred because of large specific surface. The average primary particle diameter of the vapor-phase process alumina is preferably 30 nm or less, and more preferably 20 nm or less.

In application of the fine particles as recited above to an inkjet recording medium, each of the embodiments disclosed in, for example, JP-A Nos. 10-81064, 10-119423, 10-157277, 10-217601 and 11-348409, 2001-138621, 2000-43401, 2000-211235, 2000-309157, 2001-96897 and 2001-138627, 11-91242, 8-2087, 8-2090, 8-2091, 8-2093, 8-174992 and 11-192777, and 2001-301314 may be preferably utilized as one embodiment of the present invention.

Water-Soluble Resin

The ink-receiving layer used in the invention contains at least one water-soluble resin.

Examples of the water-soluble resin include resins having hydroxyl groups as hydrophilic structural units, such as polyvinyl alcohol resins (e.g., polyvinyl alcohol (PVA), acetoacetyl-modified polyvinyl alcohol, cation-modified polyvinyl alcohol, anion-modified polyvinyl alcohol, silanol-modified polyvinyl alcohol, polyvinyl acetal), cellulose resins (e.g., methyl cellulose (MC), ethyl cellulose (EC), hydroxyethyl cellulose (HEC), carboxymethyl cellulose (CMC), hydroxypropyl cellulose (HPC), hydroxyethylmethyl cellulose, hydroxypropylmethyl cellulose), chitins, chitosans or starch; resins having ether links (e.g., polyethylene oxide (PEO), polypropylene oxide (PPO), polyethylene glycol (PEG), polyvinyl ether (PVE)); and resins having carbamoyl groups (e.g., polyacrylamide (PAAM), polyvinyl pyrrolidone (PVP), polyacrylic acid hydrazide).

In addition, the water-soluble resins may be resins having carboxyl groups as dissociative groups, with examples including polyacrylic acid salts, maleic acid resins, alginates and gelatins.

Of these resins, at least one resin selected from polyvinyl alcohol resins, cellulose resins, resins having ether links, resins having carbamoyl groups, or resins having carboxyl groups (for example, gelatins), especially polyvinyl alcohol (PVA) resins, is preferred as the water-soluble resin used in the invention.

Examples of the polyvinyl alcohol resins include the substances disclosed in JP-B Nos. 4-52786, 5-67432 and 7-29479, Japanese Patent No. 2537827, JP-B No. 7-57553, Japanese Patent Nos. 2502998 and 3053231, JP-A No. 63-176173, Japanese Patent No. 2604367, JP-A Nos. 7-276787, 9-207425, 11-58941, 2000-135858, 2001-205924, 2001-287444, 62-278080 and 9-39373, Japanese Patent No. 2750433, JP-A Nos. 2000-158801, 2001-213045, 2001-328345, 8-324105, 11-348417, 58-181687, 10-259213, 2001-72711, 2002-103805, 2000-63427, 2002-308928, 2001-205919 and 2002-264489.

In addition, examples of water-soluble resins other than the polyvinyl alcohol resins include the compounds disclosed in JP-A No. 11-165461, paragraphs [0011] and [0012], and the compounds disclosed in JP-A Nos. 2001-205919 and 2002-264489.

These water-soluble resins may be used singly or in combinations of two or more species. The water-soluble resin content in the invention is preferably from 9% to 40% by mass, and more preferably from 12% to 33% by mass, with respect to the total solid content in the ink-receiving layer.

In the invention, each of main components of the ink-receiving layer, namely, the water-soluble resin and the inorganic fine particles, may be a single material, or a mixture of multiple materials may be used for each main component.

Additionally, the kind of water-soluble resin used in combination with the inorganic fine particles, especially silica fine particles, is important from the viewpoint of transparency retention. When the vapor-phase process silica is used, the water-soluble resin used in combination is preferably a polyvinyl alcohol resin, more preferably a polyvinyl alcohol resin having a saponification degree of 70 to 100%, and particularly preferably a polyvinyl alcohol resin having a saponification degree of 80 to 99.5%.

The polyvinyl alcohol resins have hydroxyl groups in their respective structural units, and hydrogen bonds are formed between these hydroxyl groups and silanol groups present on the surfaces of silica fine particles; as a result, it becomes easy to form a three-dimensional network structure having secondary particles of silica fine particles as network chain units. It is thought that formation of such a three-dimensional network structure allows the ink-receiving layer formed to have a porous structure of a high porosity and sufficient strength.

When inkjet recording is performed, the porous ink-receiving layer formed in the foregoing manner can quickly absorb ink through capillary action and form dots of high circularity without generating ink bleeding.

The polyvinyl alcohol resin may be used in combination with other water-soluble resins. When another water-soluble resin is used in combination with the polyvinyl alcohol resin, the content of the polyvinyl alcohol resin is preferably 50% by mass or more, and more preferably 70% by mass or more relative to the total mass of water-soluble resins.

Ratio of Inorganic Fine Particle Content to Water-soluble Resin Content

By optimization of the ratio of the inorganic fine particle content (x) by mass to the water-soluble resin content (y) by mass [PB ratio (x/y)], the film structure and film strength of the ink-receiving layer can be further enhanced.

In the invention, the ratio of mass content [PB ratio (x/y)] of the ink-receiving layer is preferably in a range of 1.5 to 10 from the viewpoints of preventing film strength being decreased, and generation of cracking during drying, which are each caused by an excessively high PB ratio, and suppressing a reduction in ink absorbability due to a decrease of porosity resulting from a tendency for pores to be clogged by the resins, which develops when PB ratios are excessively low.

Herein, it is preferred that the x/y ratio in the upper-side half of the ink-receiving layer is equal to or higher than the x/y ratio in the lower-side half of the ink-receiving layer (in other words, the upper-side half and the lower-side half have the same PB ratio, or the lower-side half is richer in binder), and a case where the PB ratios in the upper-side half and the lower-side half are the same is particularly preferable.

At the time of passage through the feeding system of an inkjet printer, the recording medium is subjected to stress in some cases, so that the ink-receiving layer is required to have sufficient film strength. In addition, sufficient film strength is also necessary for the ink-receiving layer in order to suppress the occurrence of cracking and peeling of the ink-receiving layer when the recording medium is cut into sheets. In view of these factors, the mass ratio (x/y) is preferably 5 or less, and more preferably 2 or more from the viewpoint of ensuring quick ink absorption in inkjet printer.

For example, when a coating liquid prepared by completely dispersing vapor-phase process silica fine particles having an average primary particle diameter of 20 nm or less and a water-soluble resin at a mass ratio (x/y) of 2 to 5 is coated on a support and dried, a three-dimensional network is formed having secondary particles of the silica fine particles as network chains, whereby a translucent porous film having an average pore diameter of 30 nm or less, 50 to 80% porosity, 0.5 ml/g or more specific pore volume, and 100 $m^2/g$ or more specific surface area, can be easily formed.

Crosslinking Agent

From the viewpoint of crosslinking the water-soluble resin, it is preferable that the ink-receiving layer used in the invention contains at least one crosslinking agent.

As for the ink-receiving layer, a porous layer that is formed using the foregoing combination of the inorganic fine particles and the water-soluble resin in particular and hardening the water-soluble resin by crosslinking reaction with the crosslinking agent is one preferable embodiment of the invention.

For crosslinking of the water-soluble resins, especially polyvinyl alcohol, boron compounds are preferably used.

Examples of such boron compounds include borax, boric acid, borates (such as orthoborate, $InBO_3$, $ScBO_3$, $YBO_3$, $LaBO_3$, $Mg_3(BO_3)_2$ and $Co_3(BO_3)_2$), diborates (such as $Mg_2B_2O_5$ and $Co_2B_2O_5$), metaborates (such as $LiBO_2$, $Ca(BO_2)_2$, $NaBO_2$ and $KBO_2$), tetraborates (such as $Na_2B_4O_7.10H_2O$), and pentaborates (such as $KB_5O_8.4H_2O$, $Ca_2B_6O_{11}.7H_2O$ and $CsB_5O_5$). Of these boron compounds, borax, boric acid or borates, especially boric acid, are preferably used by which quick crosslinking reaction can be performed.

As crosslinking agents for the water-soluble resins, the following compounds other than the boron compounds can also be used.

For example, the compounds usable as the crosslinking agents include aldehyde compounds, such as formaldehyde, glyoxal and gurtaraldehyde; ketone compounds, such as diacetyl and cyclopentanedione; active halogen compounds, such as bis(2-chloroethylurea)-2-hydroxy-4,6-dichloro-1,3,5-triazine and sodium 2,4-dichloro-6-s-triazine); active vinyl compounds, such as divinylsulfonic acid, 1,3-vinylsulfonyl-2-propanol, N,N'-ethylenebis(vinylsulfonylacetamide) and 1,3,5-triacryloyl-hexahydro-s-triazine; N-methylol compounds, such as dimethylolurea and methyloldimethylhydantoin; melamine resins, such as methylolmelamine and alkylated methylolmelamine; epoxy resins;

isocyanate compounds, such as 1,6-hexamethylene diisocyanate; the aziridine compounds disclosed in U.S. Pat. Nos. 3,017,280 and 2,983,611; the carboxyimide compounds disclosed in U.S. Pat. No. 3,100,704; epoxy compounds, such as glycerol triglycidyl ether; ethyleneimino compounds, such as 1,6-hexamethylene-N,N'-bisethyleneurea; halogenated carboxyaldehyde compounds, such as mucochloric acid and mucophenoxychloric acid; dioxane compounds, such as 2,3-dihydroxydioxane; metal-containing compounds, such as titanium lactate, aluminum sulfate, chrome alum, potassium alum, zirconyl acetate and chromium acetate; polyamine compounds, such as tetraethylenepentamine; hydrazide compounds, such as adipic dihydrazide; and low-molecular or polymer compounds each having at least two oxazoline groups.

The crosslinking agents as recited above can be used alone or as combinations of any two or more thereof.

The amount of crosslinking agent(s) used is preferably from 1% to 50% by mass, more preferably from 5% to 40% by mass, based on the water-soluble resin.

Water-Soluble Polyvalent Metal Salt

The ink-receiving layer used in the invention preferably contains at least one water-soluble polyvalent metal compound as a mordant.

As the water-soluble polyvalent metal compound, trivalent or higher metal compounds are preferably used in the invention. Further, the polyvalent metal compounds may be water-soluble salts of metals selected from calcium, barium, manganese, copper, cobalt, nickel, aluminum, iron, zinc, zirconium, chromium, magnesium, tungsten or molybdenum.

Specific examples of such metal compounds include calcium acetate, calcium chloride, calcium formate, calcium sulfate, calcium butyrate, barium acetate, barium sulfate, barium phosphate, barium oxalate, barium naphthoresorcincarboxylate, barium butyrate, manganese chloride, manganese acetate, manganese formate dihydrate, ammonium manganese sulfate hexahydrate, cupric chloride, ammonium copper(II) chloride dihydrate, copper sulfate, copper(II) butyrate, copper oxalate, copper phthalate, copper citrate, copper gluconate, copper naphthenate, cobalt chloride, cobalt thiocyanate, cobalt sulfate, cobalt(II) acetate, cobalt naphthenate, nickel sulfate hexahydrate, nickel chloride hexahydrate, nickel acetate tetrahydrate, ammonium nickel sulfate hexahydrate, nickel amidosulfate tetrahydrate, nickel sulfaminate, nickel 2-ethylhexylhexanoate, aluminum sulfate, aluminum sulfite, aluminum thiosulfate, polyaluninum chloride, aluminum nitrate nanohydrate, aluminum chloride hexahydrate, aluminum acetate, aluminum lactate, basic aluminum thioglycolate, ferrous bromide, ferrous chloride, ferric chloride, ferrous sulfate, ferric sulfate, iron(III) citrate, iron(III) lactate trihydrate, triammonium iron(III) trioxalate trihydrate, zinc bromide, zinc chloride, zinc nitrate hexahydrate, zinc sulfate, zinc acetate, zinc lactate, zirconium acetate, zirconyl acetate, zirconium tetrachloride, zirconium chloride, zirconium oxychloride octahydrate, zirconium hydroxychloride, chromium acetate, chromium sulfate, magnesium acetate, magnesium oxalate, magnesium sulfate, magnesium chloride hexahydrate, magnesium citrate nanohydrate, sodium phosphotungstate, sodium tungsten citrate, 12-tungstophosphoric acid n-hydrate, 12-tungstosilicic acid hexacosahydrate, molybdenum chloride, 12-molybdophosphic acid n-hydrate, aluminum alum, basic polyaluminum hydroxide, zinc phenolsulfonate, ammonium zinc acetate, and ammonium zinc carbonate. These water-soluble polyvalent metal compounds may be used in combination of any two or more species. The expression "water-soluble" in the term of water-soluble polyvalent metal compound means that the polyvalent metal compound can be dissolved in water of 20° C. in a concentration of 1% by mass or more.

Among those water-soluble polyvalent metal compounds, aluminum compounds or compounds containing the group 4A metals in the periodic table (e.g., zirconium, titanium) are preferred over the others, and aluminum compounds are more preferred. Water-soluble aluminum compounds are especially preferable. As for the water-soluble aluminum compounds, for example, inorganic salts such as aluminum chloride or hydrates thereof, aluminum sulfate or hydrates thereof, and ammonium alum are known. In addition to these salts, basic polyaluminum hydroxide compounds that are inorganic aluminum-containing cationic polymers (hereafter referred to also as basic polyaluminum chloride or polyaluminum chloride) are also known, and can be preferably used.

The basic polyaluminum hydroxide compound described above is a water-soluble polyaluminum hydroxide having a main component represented by the following formula 1, 2 or 3, and stably containing a basic polymeric polynuclear condensed ion such as $[Al_6(OH)_{15}]^{3+}$, $[Al_{18}(OH)_{20}]^{4-}$, $[Al_{13}(OH)_{34}]^{5+}$ $[Al_{21}(OH)_{60}]^{3-}$.

$$[Al_2(OH)_nCl_{6-n}]_m \quad \text{Formula 1:}$$

$$[Al(OH)_3]_nAlCl_3 \quad \text{Formula 2:}$$

$$Al_n(OH)_mCl_{(3n-m)}, 0<m<3n \quad \text{Formula 3:}$$

Such basic polyaluminum hydroxide compounds are available from TAKI CHEMICAL CO., LTD. as a water treatment chemical under the trade name of Polyaluminum Chloride (PAC), Asada Chemical Industry Co., Ltd. under the trade name of Polyaluminum Hydroxide (Paho), rikengreen Co., Ltd. under the trade name of HAP-25, TAIMEI Chemicals Co., Ltd. under the trade name of ALFINE 83, or other makers as products developed with intentions similar to the above, and various grades of products are easily available.

As the water-soluble compounds containing elements of the group 4A in the periodic table, titanium- or zirconium-containing water-soluble compounds are preferred. Examples of a titanium-containing water-soluble compound include titanium chloride, titanium sulfate, titanium tetrachloride, tetraisopropyl titanate, titanium acetylacetonate, and titanium lactate. Examples of zirconium-containing water-soluble compound include zirconium acetate, zirconyl acetate, zirconium chloride, zirconium hydroxychloride, zirconium nitrate, zirconyl nitrate, basic zirconium carbonate, zirconium hydroxide, zirconium lactate, zirconyl lactate, ammonium zirconium carbonate, potassium zirconium carbonate, ammonium zirconyl carbonate, potassium zirconyl carbonate, zirconium sulfate, zirconium fluoride, zirconyl sulfate, and zirconyl fluoride compounds.

The proportion of water-soluble polyvalent metal compounds added is preferably from 0.1 to 10% by mass, and more preferably from 0.5 to 8% by mass, based on the inorganic fine particles.

Organic Nitrogen-Containing Cationic Polymer

In view of inhibition of bleeding of recorded images and dispersibility of inorganic fine particles, it is preferable that the ink-receiving layer of the present invention contains at least one organic nitrogen-containing cationic polymer.

The organic nitrogen-containing cationic polymer usable in the invention is not particularly limited, but polymers having primary, secondary or tertiary amino groups, or polymers having quaternary ammonium salt groups, are favorably used.

Preferred examples of the organic nitrogen-containing cationic polymers include a homopolymer of a monomer having a primary, secondary or tertiary amino group, or a salt thereof, or a monomer having a quaternary ammonium salt group (an organic nitrogen-containing cationic monomer), and a copolymer or condensate of the organic nitrogen-containing cationic monomer and another monomer. Further, these organic nitrogen-containing cationic polymers may be used in either form of water-soluble polymer or water-dispersible latex particle.

Examples of the organic nitrogen-containing cationic monomer include trimethyl-p-vinylbenzylammonium chloride, trimthyl-m-vinylbenzylammonium chloride, triethyl-p-vinylbenzylammonium chloride, triethyl-m-vinylbenzylammonium chloride, N,N-dimethyl-N-ethyl-N-p-vinylbenzylammonium chloride, N,N-diethyl-N-methyl-N-p-vinylbenzylammonium chloride, N,N-dimethyl-N-n-propyl-N-p-vinylbenzylammonium chloride, N,N-dimethyl-N-n-octyl-N-p-vinylbenzylammonium chloride, N,N-dimethyl-N-benzyl-N-p-vinylbenzylammonium chloride, N,N-diethyl-N-benzyl-N-p-vinylbenzylammonium chloride, N,N-dimethyl-N-(4-methyl)benzyl-N-p-vinylbenzylammonium chloride, N,N-dimethyl-N-phenyl-N-p-vinylbenzylammonium chloride, trimethyl-p-vinylbenzylammonium bromide, trimethyl-m-vinylbenzylammonium bromide, trimethyl-p-vinylbenzylammonium sulfonate, trimethyl-m-vinylbenzylammonium sulfonate, trimethyl-p-vinylbenzylammonium acetate, trimethyl-m-vinylbenzylammonium acetate, N,N,N-triethyl-N-2-(4-vinylphenyl)ethylammonium chloride, N,N,N-triethyl-N-2-(3-vinylphenyl)ethylammonium chloride, N,N-diethyl-N-methyl-N-2-(4-vinylphenyl)ethylammonium chloride, N,N-diethyl-N-methyl-N-2-(4-vinylphenyl)ethylammonium acetate, quaternarized products prepared by reacting N,N-dimethylaminoethyl(meth)acrylate, N,N-diethylaminoethyl(meth)acrylate, N,N-dimethylaminopropyl(meth)acrylate, N,N-diethylaminopropyl(meth)acrylate, N,N-dimethylaminoethyl(meth)acrylamide, N,N-diethylaminoethyl(meth)acrylamide, N,N-dimethylaminopropyl(meth)acrylamide or N,N-diethylaminopropyl(meth)acrylamide with methyl chloride, ethyl chloride, methyl bromide, ethyl bromide, methyl iodide or ethyl iodide, and sulfonates, alkylsulfonates, acetates or alkylcarboxylates obtained by anion substitution of these quaternarized products.

Examples of the quaternarized products include monomethyldiallylammonium chloride, trimethyl-2-(methacryloyloxy)ethylammonium chloride, triethyl-2-(methacryloyloxy)ethylammonium chloride, trimethyl-2-(acryloyloxy)ethylammonium chloride, triethyl-2-(acryloyloxy)ethylammonium chloride, trimethyl-3-(methacryloyloxy)propylammonium chloride, triethyl-3-(methacryloyloxy)propylammonium chloride, trimethyl-2-(methacryloylamino)ethylammonium chloride, triethyl-2-(methacryloylamino)ethylammonium chloride, trimethyl-2-(acryloylamino)ethylammonium chloride, triethyl-2-(acryloylamino)ethylammonium chloride, trimethyl-3-(methacryloylamino)propylammonium chloride, triethyl-3-(methacryloylamino)propylammonium chloride, trimethyl-3-(acryloylamino)propylammonium chloride, triethyl-3-(acryloylamino)propylammonium chloride, N,N-dimethyl-N-ethyl-2-(methacryloyloxy)ethylammonium chloride, N,N-diethyl-N-methyl-2-(methacryloyloxy)ethylammonium chloride, N,N-dimethyl-N-ethyl-3-(acryloylamino)propylammonium chloride, trimethyl-2-(methacryloyloxy)ethylammonium bromide, trimethyl-3-(acryloylamino)propylammonium bromide, trimethyl-2-

(methacryloyloxy)ethylammonium sulfonate and trimethyl-3-(acryloylamino)propylammonium acetate. In addition to the monomers recited above, N-vinylimidazole and N-vinyl-2-metylimidazole can be used as monomers copolymerizable with these monomers. Moreover, it is possible to utilize polymers having vinyl amine units converted from their original polymerizing units, such as N-vinyl acetamide or N-vinyl formamide, by hydrolysis after polymerization, or salts of the polymers.

As other monomers copolymerizable (condensatation polymerizable) with the organic nitrogen-containing cationic monomers as recited above, monomers having neither basic nor cationic moieties, such as primary, secondary and tertiary amino groups, salts thereof, or quaternary ammonium bases of the amino groups, and showing no interaction or practically weak interaction with dyes in inkjet ink can be used. Examples of such comonomers include alkyl esters of (meth) acrylic acid; cycloalkyl esters of (meth)acrylic acid, such as cyclohexyl(meth)acrylate; aryl esters of (meth)acrylic acid, such as phenyl(meth)acrylate; aralkyl esters, such as benzyl (meth)acrylate; aromatic vinyl compounds, such as styrene, vinyltoluene and α-methylstyrene; vinyl esters, such as vinyl acetate, vinyl propionate and vinyl versatates; allyl esters, such as allyl acetate; halogen-containing monomers, such as vinylidene chloride and vinyl chloride; vinyl cyanides, such as (meth)acrylonitrile; and olefins, such as ethylene and propylene.

The alkyl esters of (meth)acrylic acid are preferably those containing 1 to 18 carbon atoms in their respective alkyl moieties, with examples including methyl(meth)acrylate, ethyl(meth)acrylate, propyl(meth)acrylate, isopropyl(meth) acrylate, n-butyl(meth)acrylate, isobutyl(meth)acrylate, t-butyl(meth)acrylate, hexyl(meth)acrylate, octyl(meth) acrylate, 2-ethylhexyl(meth)acrylate, lauryl(meth)acrylate and stearyl(meth)acrylate. Of these (meth)acrylates, methyl acrylate, ethyl acrylate, methyl methacrylate, ethyl methacrylate and hydroxyethyl methacrylate are preferred over the others. These other monomers may be used alone or in combination of two or more species.

Of the organic nitrogen-containing cationic polymers recited above, cationic polyurethanes or the cationic polymers disclosed in JP-A No. 2004-167784 are preferred over the others in view of bleeding control, and cationic polyurethanes are more preferable.

Examples of commercially available products of cationic polyurethanes include SUPERFLEX 650, F-8564D and F-8570D (trade names; products of DAI-ICHI KOGYO SEIYAKU CO., LTD.), and NEOFIX IJ-150 (trade name; a product of NICCA CHEMICAL CO., LTD.).

In view of dispersibility of silica, poly(diallyldimethylammonium chloride) and derivatives of poly(methacryloyloxyethyl-β-hydroxyethyldimethylammonium chloride) are preferable, and poly(diallyldimethylammonium chloride) is more preferable.

One example of a commercially available product of such polymers is CHEMISTAT 7005 (trade name; a product of Sanyo Chemical Industries, Ltd.).

In view of obtaining more effectively the effects of the invention, a content of the organic nitrogen-containing cationic polymer in the ink-receiving layer used in the invention is preferably from 1 to 15% by mass, more preferably from 1.5 to 12% by mass, and especially from 2 to 10% by mass, based on the total solid content of the ink-receiving layer.

In the invention, the total solid content of the ink-receiving layer means all components excluding water of the composition constituting the ink-receiving layer.

Sulfur Compound

From the viewpoint of further enhancing ozone resistance, it is preferable that the ink-receiving layer used in the invention contains at least one sulfur compound.

The sulfur compound contained is preferably at least one sulfur compound selected from thioether compounds, thiourea compounds, disulfide compounds, sulfinic acid compounds, thiocyanic acid compounds, sulfur-containing heterocyclic compounds, or sulfoxide compounds.

Specific examples of the sulfur compound favorably applicable to the ink-receiving layer used in the invention include those described in paragraphs [0054] to [0117] of JP-A No. 2008-246988.

Among these sulfur compounds, at least one compound selected from thioether compounds or sulfoxide compounds is preferable from the viewpoint of the ozone resistance.

Thioether Compound

The thioether compound used for the foregoing purpose may be a water-soluble compound or an oil-soluble compound. In addition, the thioether compound may be a low or high molecular compound, as far as the compound has at least one thioether group in the molecule thereof.

The number of carbon atoms in the thioether compound is preferably 2 or more, and more preferably 4 or more.

In addition to sulfur, carbon and hydrogen atoms for constituting a thioether compound, it is preferable that the thioether compound further contains an atom or atoms having lone-pair electrons (such as an oxygen, sulfur, nitrogen or phosphorus atom).

Examples of the thioether compound include compounds represented by the following Formula (2).

$$R_1—(S—R_3)_m—S—R_2 \qquad \text{Formula (2)}$$

In Formula (2), $R_1$ and $R_2$ each independently represent a hydrogen atom, a substituted or unsubstituted alkyl group, a substituted or unsubstituted aryl group, or an alkyl- or aryl-containing group. Further, $R_1$ and $R_2$ may be the same or different, and may combine with each other to form a ring. However, at least either $R_1$ or $R_2$ must be an alkyl group substituted with an hydrophilic group, such as a hydroxyl group, a sulfo group, a carboxyl group or a (poly)ethylene oxide group, or with a basic nitrogen-containing group, such as an amino group, an amido group, an ammonium group, a nitrogen-containing heterocyclic group, an aminocarbonyl group or an aminosulfonyl group, or a group containing such a substituted alkyl group (for example, this substituted alkyl group may further be bound to the sulfur atom of the thioether via a divalent linkage group, such as a carbamoyl group, a carbonyl group or a carbonyloxy group). $R_3$ represents an alkylene group which may be substituted and which, in some cases, may have an oxygen atom. m represents an integer of 0 to 10. When m is 1 or more, at least one sulfur atom bound to $R_3$ may be a sulfoxide group or a sulfonyl group. In addition, $R_1$ and $R_2$ each may be a polymer residue.

Of the compounds represented by Formula (2), thioether compounds wherein at least either $R_1$ or $R_2$ represent an alkyl group substituted with a hydroxyl group, a carboxyl group, an amino group or an ammonium group are especially preferred over the others. Examples of the amino group with which the alkyl group is substituted include an amino group, an monoalkylamino group (the alkyl moiety of which is preferably an alkyl group having 1 to 5 carbon atoms) and a dialkylamino group (each alkyl moiety of which is preferably an alkyl group having 1 to 5 carbon atoms), and further the amino group may be a nitrogen-containing heterocyclic group. Examples of compounds represented by Formula (2) include those described in paragraphs [0058] to [0062] of JP-A No. 2008-246988.

Sulfoxide Compound

The sulfoxide compound used may be a water-soluble compound or an oil-soluble compound. In addition, the compound may be a low or high molecular compound, as far as the compound has at least one sulfoxide group in the molecule thereof.

The number of carbon atoms in the sulfoxide compound used is preferably 2 or more, and more preferably 4 or more.

In addition to a sulfoxide group, carbon atoms and hydrogen atoms, it is preferable that the sulfoxide compound further contains an atom or atoms having lone-pair electrons (such as an oxygen, sulfur, nitrogen or phosphorus atom).

Examples of the sulfoxide compound favorably applicable to the invention include those described in paragraphs [0079] to [0091] of JP-A No. 2008-246988.

From the viewpoints of further enhancing ozone resistance and keeping the image density higher, a content of the sulfur compound in the ink-receiving layer used in the invention is preferably from 0.5 to 5% by mass, more preferably from 1 to 4% by mass, and especially from 1.5 to 3% by mass, based on the total solid content of the ink-receiving layer.

Other Components

The ink-receiving layer used in the invention may further contain other components such as a mordant other than the organic nitrogen-containing cationic polymer and the water-soluble polyvalent metal compound, or various kinds of surfactants.

The other components used in the invention may be appropriately selected from components described in paragraphs [0088] to [0117] of JP-A No. 2005-14593 and paragraphs [0138] to [0155] of JP-A No. 2006-321176.

Substrate

As the substrate in the invention, either a transparent substrate made of a transparent material such as plastic or an opaque substrate made of an opaque material such as paper may be used. In order to make use of the transparency of the ink-receiving layer, it is preferable to use a transparent substrate or a high-gloss opaque substrate. Alternatively, the substrate used in the invention may be a read-only optical disc, such as CD-ROM or DVD-ROM, a write-once optical disc, such as CD-R or DVD-R, or a rewritable optical disc, and on the label side of such the disc support, the ink-receiving layer may be provided.

A transparent material having resistance to radiant heat applied thereto when the medium is used on an OHP or back light display is preferable as a material for the transparent substrate. Examples of the material include polyesters such as polyethylene terephthalate (PET), polysulfone, polyphenylene oxide, polyimide, polycarbonate, polyamide and the like. Among them, polyesters are preferable, and polyethylene terephthalate is particularly preferable.

The thickness of the transparent substrate is not particularly limited, but it is preferably from 50 to 200 μm from the viewpoint of easy handling.

The high-gloss opaque substrate preferably has a glossiness of 40% or more on the surface where the ink-receiving layer is formed. The glossiness is a value determined by a known method taught by JIS P-8142, i.e., Measurement of 75 degree mirror gloss paper and board. Specific examples of the substrates include the following:

Specific examples of the high-gloss opaque substrate include high-gloss paper substrates such as art paper, coated paper, cast-coated paper, baryta paper commonly used as a silver salt photographic substrate and the like; high-gloss films opacified by adding a white pigment or the like to any one of plastic films such as polyesters such as polyethylene terephthalate (PET); cellulose esters such as nitrocellulose, cellulose acetate, or cellulose acetate butylate; polysulfone, polyphenylene oxide, polyimide, polycarbonate, polyamide or the like (which may be additionally subjected to a surface calendar treatment); and substrates having a polyolefin coating layer containing or not containing a white pigment, that is formed on the surface of the above-described various papers, transparent substrates or the high-gloss films containing a white pigment.

Foamed polyester films containing a white pigment (e.g., foamed polyester formed by stretching a polyolefin fine particle-containing PET film so as to form voids therein) are also favorable and are included as an example. In addition, resin coated papers commonly used as photographic papers for silver salt photographs are also preferable.

The thickness of the opaque substrate is not particularly limited, but it is preferably from 50 to 300 μm from the viewpoint of easy handling.

The surface of substrate may be subjected to corona discharge treatment, glow discharge treatment, flame treatment, ultraviolet ray irradiation treatment or the like for improvement in wetting property and adhesiveness.

Then, a base paper used in the resin-coated papers is described in detail.

The base paper is made from wood pulp as a principal material and, if needed, synthetic pulp made from, e.g., polypropylene, or synthetic fiber, such as nylon fiber or polyester fiber, as an additional material. As the wood pulp, any of LBKP, LBSP, NBKP, NBSP, LDP, NDP, LUKP and NUKP can be used. It is advantageous to use wood pulp with a high content of short fibers, such as LBKP, NBSP, LBSP, NDP and LDP.

However, the proportion of LBSP and/or LDP is preferably from 10% to 70% by mass.

Chemical pulps (such as sulfate salt pulp or sulfite pulp) containing a smaller amount of impurities are preferably used as the pulp used in the invention. Bleached pulps whereby whiteness is improved are also useful.

Various additives including a sizing agent such as higher fatty acid or alkylketene dimer; a white pigment such as calcium carbonate, talc or titanium oxide; a paper-strengthening additive such as starch, polyacrylamide or polyvinyl alcohol; a fluorescent whitening agent; a moisturizing agent such as polyethylene glycols; a dispersing agent; a softener such as quaternary ammonium, and the like may be added to the base paper in accordance with necessity.

The freeness of the pulp for use in paper making is preferably 200 to 500 ml according to the CSF (Canadian Standard Freeness) Regulations. In regard to the fiber length after beating, all the pulps remaining on both 24- and 42-mesh screens is preferably 30 to 70% by mass, as determined by the known method set forth in JIS P-8142. Further, the pulp remaining on 4-mesh screen is preferably 20% by mass or less.

The basis weight of base paper is preferably from 30 to 250 $g/m^2$, particularly preferably from 50 to 200 $g/m^2$. The thickness of base paper is preferably from 40 to 250 μm. It is also possible to impart high smoothness to the base paper by performing a calendar treatment during or after papermaking The base paper density is generally from 0.7 to 1.2 $g/m^3$ (JIS P-8118).

Furthermore, the stiffness of base paper is preferably from 20 to 200 g under the conditions defined by JIS P-8143.

The base paper surface may be coated with a surface sizing agent, and the same sizing agent as those added to the interior of base paper can also be used as the surface sizing agent.

The pH of base paper is preferably from 5 to 9 when measured according to the hydrothermal extraction method set forth in JIS P-8113.

The polyethylene covering the front and rear surfaces of the base paper is mainly a low-density polyethylene (LDPE) and/or a high-density polyethylene (HDPE), but other LLDPE, polypropylene, or the like may also be used partially.

In particular, as commonly used in photographic papers, the polyethylene layer on which the ink-receiving layer is provided is preferably formed of polyethylene containing rutile-titanium oxide, anatase-titanium oxide, a fluorescent whitening agent, and/or ultramarine whereby opacity, whiteness and hue are improved. The content of the titanium oxide is preferably from about 3 to 20% and more preferably from 4 to 13% by mass relative to the polyethylene. The thickness of the polyethylene layer is not particularly limited, but the thickness of either front or rear layer is favorably in a range of 10 to 50 μm. In addition, an undercoat layer may be formed on the polyethylene layer for increasing the adhesiveness thereof to an ink-receiving layer. Hydrophilic polyester, gelatin, and PVA are preferable for the undercoat layer. The thickness of the undercoat layer is preferably in a range of 0.01 to 5 μm.

The polyethylene-coated paper may be used as a glossy paper.

The polyethylene layer coated on the surface of the base paper by melt-extrusion may be further subjected to a so-called surface roughening treatment so that it has a mat or silky surface similar to that of common photographic printing papers.

The substrate can be provided with a back coat layer. To the back coat layer, white pigment, aqueous binder and other ingredients can be added.

Examples of white pigment that can be incorporated into the back coat layer include inorganic white pigments, such as light calcium carbonate, heavy calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo-boehmite, aluminum hydroxide, alumina, lithopone, zeolite, hydrous halloysite, magnesium carbonate and magnesium hydroxide; and organic pigments, such as styrene-base plastic pigment, acrylic plastic pigment, polyethylene, microcapsules, urea resin and melamine resin.

Examples of the aqueous binders for use in the back coat layer include water-soluble polymers such as styrene/maleic acid salt copolymers, styrene/acrylic salt copolymers, polyvinyl alcohol, silanol-modified polyvinyl alcohols, starch, cationic starch, casein, gelatin, carboxymethylcellulose, hydroxyethylcellulose, or polyvinylpyrrolidone; water-dispersible polymers such as styrene butadiene latexes or acrylic emulsions; and the like.

Examples of the other components contained in the back coat layer include a defoaming agent, an antifoaming agent, a dye, a fluorescent whitening agent, an antiseptic, a water resistant additive, and the like.

Others

In addition to the ink-receiving layer, the present inkjet recording medium may further have an ink-solvent absorption layer, an interlayer and a protective layer. Furthermore, a subbing layer may also be provided on the substrate for the purposes of enhancing adhesion between the substrate and the ink-receiving layer and adjusting the electric resistance appropriately.

To constituent layers (e.g., the ink-receiving layer and the back coat layer) of the present inkjet recording medium, a polymer fine-particle dispersion may be added. This polymer fine-particle dispersion is used for the purpose of improving film properties, such as film's dimensional stability and anti-curling, anti-sticking and anti-cracking properties. Descriptions of the polymer fine-particle dispersion are described, e.g., in JP-A Nos. 62-245258 and 10-228076. Additionally, when a dispersion of polymer fine particles having a low glass transition temperature (40° C. or below) is added to a layer containing a mordant as recited above, cracking and curling of the layer can be suppressed. Alternatively, curling can be also suppressed by adding a dispersion of polymer fine particles having a high glass transition temperature to the backing layer.

Additionally, the ink-receiving layer may be provided on only one side of the substrate, or alternatively may be provided on both sides of the substrate in order to prevent deformation, such as curling. When the ink-receiving layer is on only one side of the substrate in preparing a recording medium for use in OHP or the like, an antireflection coating can also be provided on the side opposite to the ink-receiving layer or both sides of the substrate for the purpose of enhancing optical transparency.

Further, it is also possible to apply boric acid or a boron compound to the substrate surface on the side where the ink-receiving layer is to be provided and then form thereon the ink-receiving layer, which can ensure glossiness and surface smoothness for the ink-receiving layer and also can suppress bleeding with ageing on the printed image under the high-temperature and high-humidity environments.

Method of Manufacturing Inkjet Recording Medium

A first exemplary embodiment of a method of manufacturing the present inkjet recording medium is a method including a process of forming a coating layer by applying a coating liquid containing at least inorganic fine particles, a water-soluble resin, and an ethylene oxide adduct of an acetylene glycol compound having an HLB value of 6 or less, and a process of performing cross-link hardening of the coating layer by applying a second solution containing a basic compound at either (1) the same time as at least the coating liquid is applied or (2) a stage in the course of drying of the coating layer formed by applying at least the coating liquid and before the coating layer shows decreasing-rate drying.

Further, a second exemplary embodiment of a method of manufacturing the present inkjet recording medium is a method including a process of forming a coating layer on a substrate by applying to the substrate, a coating liquid containing at least inorganic fine particles, a water-soluble resin, and an ethylene oxide adduct of an acetylene glycol compound having an HLB value of 6 or less, and a process of a process of cooling the coating layer to a temperature at least 5° C. lower than the temperature at which the coating liquid is applied, and a process of forming an ink-receiving layer by drying the coating layer thus cooled.

Process of Forming Coating Layer

Each of the first and second exemplary embodiments has a process of forming a coating layer by applying a coating liquid containing at least inorganic fine particles, a water-soluble resin, and an ethylene oxide adduct of an acetylene glycol compound having an HLB value of 6 or less (Hereinafter, this process is also referred to as the coating-layer formation process.)

In the coating-layer formation process, though it is necessary to apply to the substrate the above-described coating liquid, other coating liquids may further be applied, if needed. In addition, a solution for barrier layer (interlayer solution) may be laid between any adjacent two of the solutions applied.

The mode of applying these coating liquids is not particularly limited. When two or more coating liquids are applied to a substrate, coating layers may be formed in accordance with a simultaneous multilayer coating method hitherto known, or they may be formed into a coating layer on a one-by-one basis (by sequential application) in accordance with a heretofore-known method.

The simultaneous multilayer coating can be performed using known coating apparatus, such as an extrusion die coater and a curtain flow coater.

Further the sequential coating can be performed using known coating apparatus, such as an extrusion die coater, an air doctor coater, a blade coater, a rod coater, a knife coater, a squeegee coater, a reverse roll coater and a bar coater.

The application quantity of the coating liquid on a wet basis is preferably from 100 to 400 ml/m$^2$, and more preferably from 150 to 300 ml/m$^2$, while the application quantity of the coating liquid on a solids basis is preferably from 10 to 50 g/m$^2$, and more preferably from 20 to 36 g/m$^2$.

Coating Liquid

The coating liquid used in the invention contains at least one species of inorganic fine particles, at least one water-soluble resin, and at least one ethylene oxide adduct of an acetylene glycol compound having an HLB value of 6 or less, and further may contains other components such as a crosslinking agent, a mordant, a dispersant, a surfactant, or the like.

When the coating liquid is applied, it is also preferable that the coating liquid is subjected to in-line mixing with a solution containing the water-soluble polyvalent metal salt as recited above (preferably a basic polyaluminum chloride), and then applied.

Details of various ingredients including the inorganic fine particles, the sulfur compound, the water-soluble resin, the crosslinking agent, the mordant and the water-soluble polyvalent metal compound are the same as described in the section <Ink-Receiving Layer>, and preferred forms of those ingredients are also the same as specified in that section.

The coating liquid is preferably acidic, and the pH thereof is preferably 5.0 or below, more preferably 4.5 or below, and further preferably 4.0 or below.

The pH range can be adjusted by appropriately choosing the kind and amount of the cationic polymer added. Alternatively, the pH adjustment may be made by addition of an organic or inorganic acid. When the pH of the coating liquid is 5.0 or below, crosslinking reaction of the water-soluble resin with a crosslinking agent (a boron compound in particular) in the coating liquid can be adequately inhibited.

Preparation Method of Coating Liquid

In the invention, the coating liquid containing at least inorganic fine particles, a water-soluble resin and an ethylene oxide adduct of an acetylene glycol compound having an HLB value of 6 or less can be prepared, for example, by adding the ethylene oxide adduct of the acetylene glycol compound having an HLB value of 6 or less to a mixture prepared as follows.

Specifically, vapor-phase process silica fine particles and a dispersant are added to water (so that the silica fine particles added has a content of 0 to 20% by mass in water), subjected to a dispersing operation using a rapidly rotating wet colloidal mill (e.g., CLEARMIX, trade name, made by M TECHNIQUE) under conditions that the dispersion time is, e.g., 20 minutes (preferably from 10 to 30 minutes) and the revolutions are, e.g., as high as 10,000 rpm (preferably from 5,000 to 20,000 rpm). To the resulting dispersion, a crosslinking agent (e.g., boric acid), an aqueous polyvinyl alcohol (PVA) solution (in such an amount that the PVA content becomes about one-third by mass basis of the vapor-phase process silica content) and a nitrogen-containing organic cationic polymer are added, and further the above-described water-soluble polyvalent metal salt (e.g., zirconyl acetate, basic polyaluminum hydroxide) is added, and then subjected to the dispersion operation under the same rotational conditions as mentioned above, thereby preparing the coating liquid.

The water-soluble polyvalent metal salt may be added by in-line mixing just before application.

As an alternative machine for the dispersing operations, a liquid-liquid collision dispersing machine (e.g., ULTIMIZER, trade name, made by Sugino Machine Ltd.) can also be used.

The coating solution thus obtained is in a homogeneous sol state, and this solution is applied to a substrate in accordance with the following application method, and then dried. Thus, a porous ink-receiving layer having a three-dimensional network structure can be formed.

The aqueous dispersion containing the vapor-phase process silica and the dispersant may be prepared by preparing in advance an aqueous dispersion of the vapor-phase process silica and then adding the aqueous dispersion to an aqueous dispersant solution or adding an aqueous dispersant solution to the aqueous dispersion of the vapor-phase process silica, or mixing them simultaneously. Alternatively, vapor-phase process silica powder, not the aqueous dispersion of vapor-phase process silica, may be directly added to the aqueous dispersant solution.

After mixing the vapor-phase process silica and the dispersant, the resulting mixture is subjected to grain refining by use of a dispersing machine, and thereby an aqueous dispersion having an average particle size of 50 to 300 nm can be obtained. Examples of a dispersing machine usable for obtaining such an aqueous dispersion include a variety of hitherto known dispersing machines, such as a rapidly rotating dispersing machine, a medium agitation-type dispersing machine (such as a ball mill or a sand mill), a ultrasonic dispersing machine, a colloid mill dispersing machine and a high-pressure dispersing machine. Of these dispersing machines, an agitation-type dispersing machine, a colloid mill dispersing machine and a high-pressure dispersing machine are preferred over the others from the viewpoint of effectively dispersing clotted fine grains.

In each of the foregoing steps, water, an organic solvent or a mixture thereof can be used as solvent. Examples of an organic solvent usable in the application include alcohol compounds such as methanol, ethanol, n-propanol, isopropanol and methoxypropanol; ketones such as acetone and methyl ethyl ketone; tetrahydrofuran, acetonitrile, ethyl acetate and toluene.

As the dispersant, a cationic polymer is used. Examples of the cationic polymer include mordants disclosed in JP-A No. 2006-321176, paragraphs [0138] to [0148]. Alternatively, the use of a silane coupling agent as the dispersant is also advantageous.

The amount of the dispersant added is preferably from 0.1% to 30%, more preferably from 1% to 10%, based on the inorganic fine particles.

Hardening Process

The above-described first exemplary embodiment has a process of performing cross-link hardening of the coating layer formed in the coating-layer formation process by application of a basic compound-containing second solution at either (1) the same time as at least the coating liquid is applied or (2) a stage in the course of drying of the coating layer formed by applying at least the coating liquid, and before the coating layer shows decreasing-rate drying. Hereafter, this process is also referred to as hardening process.

As a method of applying the second coating liquid "(1) at the same time as at least the coating liquid is applied", the mode of simultaneous coating (multilayer coating) in which the coating liquid and the second solution are applied simultaneously in this order from the substrate, is suitable.

The simultaneous coating (multilayer coating) can be performed using known coating apparatus, such as an extrusion die coater or a curtain flow coater.

A method of applying the second solution "(2) at a stage in the course of drying of the coating layer formed by applying at least the coating liquid, and before the coating layer shows decreasing-rate drying" is the method referred to as "Wet-On-Wet method" or "WOW method". Details of "Wet-On-Wet method" are described, for example, in JP-A No. 2005-14593, paragraphs [0016] to [0037].

In the invention, after a coating layer is formed by coating the coating liquid, the second solution is applied at a stage in the course of drying of the coating layer formed, and before the coating layer shows decreasing-rate drying, according to (i) a method of further applying the second solution to the coating layer formed, (ii) a method of spraying the second solution on the coating layer formed, or (iii) a method of immersing the coating layer-provided substrate in the second solution.

Method available for applying the second layer coating liquid in the method (i) include methods known in the art using a coating machine such as curtain flow coater, extrusion die coater, air doctor coater, blade coater, rod coater, knife coater, squeeze coater, reverse roll coater and bar coater. A method of using extrusion die coater, curtain flow coater or bar coater is preferable, since these methods are each able to use a coater without direct touch with the already formed coating layer.

The expression "before the coating layer exhibits decreasing-rate drying" in the hardening process usually refers to a period of several minutes from immediately after the application of the above-described coating solution, and in this course the coating layer applied exhibits the phenomenon of "constant-rate drying" in which the solvent (dispersion medium) content in the coating layer applied decreases in proportion to a lapse of time. On the time for such "constant-rate drying", there are descriptions in, e.g., Kagaku Kogaku Binran (Handbook of Chemical Technology), pp. 707-712, MARUZEN Co., Ltd. (Oct. 25, 1980).

As to the conditions for drying the coating layer until it comes to show decreasing-rate drying, they are generally chosen from the drying temperature range of 40° to 180° C. and the drying time range of 0.5 to 10 minutes (preferably 0.5 to 5 minutes). Although it is natural that the drying time varies according to the application quantity, the range specified above is usually appropriate.

Second Solution

Hereafter, the second solution for use in the hardening process is described.

Basic Compound

The second solution for use in the invention contains at least one basic compound. Examples of the basic compound include ammonium salts of weak acids, alkali metal salts of weak acids (such as lithium carbonate, sodium carbonate, potassium carbonate, lithium acetate, sodium acetate and potassium acetate), alkaline earth metal salts of weak acids (such as magnesium carbonate, barium carbonate, magnesium acetate and barium acetate), ammonium hydroxide, primary to tertiary amines (such as triethylamine, tripropylamine, tributylamine, trihexylamine, dibutylamine and butylamine), primary to tertiary anilines (such as diethylaniline, dibutylaniline, ethylaniline and aniline) and pyridines which may have substituents (such as 2-aminopyridine, 3-aminopyridine, 4-aminopyridine and 4-(2-hyroxyethyl)-aminopyridine).

In addition to the basic compounds recited above, the basic compound may be used together with other basic substances and/or salts thereof. Examples of the other basic substances include ammonia, primary amines such as ethylamine and polyallylamine, secondary amines such as dimethylamine, tertiary amines such as N-ethyl-N-methylbutylamine, and hydroxides of alkali metals and alkaline earth metals.

Of these basic compounds recited above, ammonium salts of weak acids are preferred over the others. The term "weak acids" refers to inorganic or organic acids having pKa of 2 or more as described, e.g., in Kagaku Binran Kiso hen II (Handbook of Chemistry Basic Edition II), published by MARUZEN Co., Ltd. Examples of the ammonium salts of weak acids include ammonium carbonate, ammonium hydrogen carbonate, ammonium borate, ammonium acetate and ammonium carbamate, but they are not limited to these salts. Of these salts, ammonium carbonate, ammonium hydrogen carbonate, or ammonium carbamate is preferably used from the point that they do not remain in the layer after drying and ink bleeding is reduced.

Additionally, the basic compound may be used in combination of two or more thereof.

The content of the basic compound (especially an ammonium salt of weak acid) in the second solution is preferably from 0.5% to 10% by mass, and more preferably from 1% to 5% by mass, based on all ingredients (including a solvent) of the second solution. By adjusting the content of the basic compound (especially an ammonium salt of weak acid) to the foregoing range in particular, a sufficient degree of hardening can be attained and impairment of a working environment due to too high ammonia concentration can be prohibited.

Metal Compound

The second solution for use in the invention preferably contains at least one metal compound.

As to the metal compound to be incorporated in the second solution, any compounds are usable as long as they are stable under basic conditions. Specifically, any of the water-soluble polyvalent metal salts as recited above, metal complex compounds, inorganic oligomers and inorganic polymers may be used. More specifically, zirconium compounds and the compounds recited as inorganic mordants in JP-A No. 2005-14593, paragraphs [0100] and [0101], are used to advantage. And examples of usable metal complex compounds include the metal complexes described in Kagaku Sosetsu (Chemistry Review), No. 32 (1981), edited by The Chemical Society of Japan, and the transition metal complexes containing transition metals (for example, ruthenium) as described in Coordination Chemistry Review, vol. 84, pp. 85-277 (1988), and JP-A No. 2-182701.

Among these compounds recited above, zirconium compounds or zinc compound, especially zirconium compounds, are preferred over the others. Examples of such zirconium compounds include ammonium zirconium carbonate, ammonium zirconium nitrate, potassium zirconium carbonate, ammonium zirconium citrate, zirconyl stearate, zirconyl octylate, zirconyl nitrate, zirconium oxychloride and zirconium hydroxychloride. Of these zirconium compounds, ammonium zirconium carbonate is used to particular advantage. In the second solution, two or more metal compounds (preferably including a zirconium compound) may also be used in combination.

The content of the metal compound (a zirconium compound in particular) in the second solution is preferably from 0.05% to 5% by mass, and more preferably from 0.1% to 2% by mass, based on all ingredients (including a solvent) of the second solution. By adjusting the content of a metal compound (a zirconium compound in particular) to the foregoing range, not only hardening of the coating layer can be fully achieved, but also insufficient print density and bleeding due to reduction in mordanting capability can be prohibited, and besides, no deterioration of a working environment due to too high concentration of basic compound, such as ammonia, is caused. Further, two or more metal compounds may be used in combination. When a metal compound is used in combination with a mordant other than metal compounds among the below-described other mordant components, the mordant can be used in such an amount that the total content of the metal compound and the mordant falls within the range specified above and also no impairment of effects of the invention occurs.

In terms of image density and ozone resistance, it is also preferable that the second solution contains, as a metal compound, magnesium salts recited above. As the magnesium salt, magnesium chloride is particularly preferable.

In this case, the amount of the magnesium salt added is preferably from 0.1% to 1% by mass, and more preferably from 0.15% to 0.5% by mass, based on all ingredients of the second solution.

The second solution may contain a crosslinking agent and other mordant components as required.

When the second solution is used in an alkaline state, hardening may be accelerated. Accordingly, the pH thereof is adjusted preferably to 7.1 or higher, more preferably to 8.0 or higher, and particularly preferably to 9.0 or higher. When the pH is 7.1 or higher, the crosslinking reaction of the water-soluble resin contained in the coating liquid for the ink-receiving layer may be further promoted and further bronzing and cracking of the ink-receiving layer may be suppressed more effectively.

The second solution can be prepared by adding to, for example, ion exchange water a metal compound (such as a zirconium compound at, for example, a concentration of 1 to 5%) and a basic compound (such as ammonium carbonate at, for example, 1 to 5%), and further paratoluenesulfonic acid (at, for example, 0.5 to 3%) as required, and then thoroughly stirring them. Herein, "%" for each ingredient represents % by mass of solid content.

As to the solvent for preparation of the second solution, water, an organic solvent or a mixture thereof is usable. Examples of an organic solvent which can be used for application include alcohol compounds such as methanol, ethanol, n-propanol, isopropanol and methoxypropanol; ketones such as acetone and methyl ethyl ketone; tetrahydrofuran, acetonitrile, ethyl acetate and toluene.

Cooling Process and Drying Process

The second exemplary embodiment of the production method has a process of cooling the coating layer formed in the above-described coating layer formation process to a temperature at least 5° C. lower than the temperatures at the time of the above-described coating process (hereinafter, also referred to as "a cooling process"), and a process of forming an ink-receiving layer by drying the coating layer thus cooled (hereinafter, also referred to as "a drying process").

As a method of cooling the coating layer in the cooling process, it is preferable to use a method of cooling the substrate, on which the coating layer is formed, for 5 to 30 seconds in a cooling zone kept at temperatures ranging from 0° to 10° C.

In the cooling process, it is preferable that cooling is performed so that the temperature is decreased to the range of 0° to 10° C., and more preferably from 0° to 5° C.

Herein, the temperature of the coating layer is determined by temperature measurement made on the coating surface.

Other Processes

In the first and the second exemplary embodiments, the surface smoothness, glossiness, transparency and strength of coated layer may be improved by subjecting an ink receiving layer formed on a substrate to a calendar treatment whereby the ink receiving layer is passed through roll nips under heat and pressure using a super calendar or gloss calendar machine. However, since in some cases the calendar treatment may cause a decrease of the porosity (resulting in a decrease in ink absorbing property), conditions in which reduction of the porosity is small should be employed.

The roll temperature in the case of performing a calendar treatment is preferably from 30° to 150° C., and more preferably from 40° to 100° C.

The linear pressure between rolls at the time of calendar treatment is preferably from 50 to 400 kg/cm, and more preferably from 100 to 200 kg/cm.

Inkjet Recording Method

As to the inkjet recording method for recording images on the present inkjet recording medium, there is no particular restriction, and various known methods can be used which include a charge control method in which ink are jetted by utilizing electrostatic attraction, a drop-on-demand method (a pressure pulse method) which utilizes vibration pressure of a piezo device, an acoustic inkjet method in which ink is irradiated with acoustic beams converted from electric signals and the radiation pressure created thereby is utilized for ink jetting, and a thermal inkjet method in which bubbles are formed by heating of ink and the pressure generated thereby is utilized. In addition, a method in which small volumes of great many droplets of low-density ink referred to as photo ink are jetted, a method of improving image quality by using plural kinds of ink having substantially the same color hue but different density, and a method of using colorless, transparent ink are included in the foregoing inkjet recording methods.

EXAMPLES

The present invention will now be illustrated in more detail by reference to the following examples, but the invention should not be construed as being limited by these examples. Additionally, all "parts" and all "%" in the examples are by mass unless otherwise noted.

Example 1

Production of Inkjet Recording Medium

Making of Substrate

Wood pulp constituted of 100 parts of LBKP was beaten to a Canadian freeness of 300 ml by means of a double disk refiner, and 0.5 parts of epoxidized behenic acid amide, 1.0 parts of anionic polyacrylamide, 0.1 parts of polyamide-polyamine epichlorohydrin and 0.5 parts of cationic polyacrylamide were added in bone dry mass ratio to the pulp. A raw paper of 170 g/m$^2$ was made from the resulting pulp by means of a Fourdrinier paper machine.

In order to adjust the surface size of the raw paper thus formed, a 4% aqueous polyvinyl alcohol solution to which 0.04% of a fluorescent whitening agent (Whitex BB, trade name, manufactured by Sumitomo Chemical Co., Ltd.) had been added was impregnated in the raw paper so as to form a 0.5 g/m$^2$ coating on an absolute dry weight basis. The resultant base paper was dried and then subjected to a calendering treatment so that the density of the base paper was adjusted to 1.05.

The base paper thus obtained was subjected to a corona discharge treatment on the wire side (back side), and then coated with high-density polyethylene using a melt extrusion machine so as to have a film thickness of 19 μm, thereby forming a resin layer having a matte surface (hereinafter, this resin layer side is referred to as "back side"). This resin layer on the back side was further subjected to a corona discharge treatment, and thereto a dispersion prepared by dispersing into water aluminum oxide (ALUMNA SOL 100, trade name, manufactured by Nissan Chemical Industries, Ltd.) and silicon dioxide (SNOWTEX O, trade name, manufactured by Nissan Chemical Industries, Ltd.) at a ratio of 1:2 by mass as antistatic agents was applied so as to have a dry weight of 0.2 g/m$^2$.

Further, the base paper was subjected to a corona discharge treatment on the felt side (top side) where the resin layer was not provided, and then coated with low-density polyethylene which had an MFR (melt flow rate) of 3.8 and contained 10% of anatase-type titanium dioxide, a very small amount of ultramarine blue and 0.01% of a fluorescent whitening agent (based on the polyethylene) using a melt extrusion machine so as to provide a film thickness of 29 μm, thereby to form a high-gloss thermoplastic resin layer on the top side of the base paper (hereinafter, this high-gloss surface is referred to as "the front surface"). The thus-obtained resin-laminated base paper was used as substrate 1 in the present example.

Preparation of Coating Liquid

As shown in the following composition, (1) vapor-phase process silica fine particles, (2) ion exchange water, (3) SHALLOL DC-902P, (4) ZA-30, (5) methionine sulfoxide, and (6) boric acid were mixed, and dispersed with a liquid-liquid collision dispersing machine (ULTIMIZER, trade name, made by Sugino Machine Ltd.). Then, the dispersion obtained was heated up to 45° C. and kept for 20 hours as it was. Thereafter, (7) a polyvinyl alcohol-dissolved liquor was added to the dispersion at a temperature of 30° C., thereby to prepare coating liquid 1 (a coating liquid for forming an ink-receiving layer).

The mass ratio of the silica fine particles to the water-soluble resin (PB ratio=(1): (7)) was 4.9:1, and the coating liquid 1 was an acidic liquid having pH of 3.4.

Composition of Coating Liquid 1

| | |
|---|---|
| (1) Vapor-phase process silica fine particles (inorganic fine particles, AEROSIL 300SF75, trade name, manufactured by NIPPON AEROSIL CO., LTD.) | 8.9 parts |
| (2) Ion exchange water | 54.8 parts |
| (3) SHALLOL DC-902P (51.5% aqueous solution, a dispersant, nitrogen-containing organic cationic polymer, manufactured by DAI-ICHI KOGYO SEIYAKU CO., LTD.) | 0.78 parts |
| (4) ZA-30 (trade name, zirconium acetate manufactured by DAIICHI KIGENSO KAGAKU KOGYO CO., LTD.) | 0.48 parts |
| (5) Methionine sulfoxide (30% aqueous solution, sulfur compound) | 0.88 parts |
| (6) Boric acid (crosslinking agent) | 0.4 parts |
| (7) Polyvinyl alcohol (water-soluble resin)-dissolved liquor | 25.9 parts |

Composition of Dissolved Liquor

| | |
|---|---|
| PVA235 (trade name, saponification degree: 88%, polymerization degree: 3500, manufactured by KURARAY CO., LTD.) | 1.8 parts |
| Ion exchange water | 23.5 parts |
| Diethylene glycol monobutyl ether (Butycenol 20P, trade name, manufactured by Kyowa Hakko Chemicals Co., Ltd.) | 0.55 parts |
| Surfynol 420 (Ethylene oxide adduct of acetylene glycol compound, HLB value 4, Surfactant, trade name, manufactured by Nisshin Chemical Industry Co., Ltd.) | 0.07 parts |
| (8) SUPERFLEX 650 (Nitrogen-containing organic cationic polymer emulsion, manufactured by DAI-ICHI KOGYO SEIYAKU CO., LTD.) | 1.5 parts |

Formation of Ink-Receiving Layer

The front surface of the above-described substrate 1 was subjected to a corona discharge treatment. Thereafter, the above-described coating liquid and the following in-line solution were subjected to in-line mixing at rates of 196 g/m$^2$ and 16.5 g/m$^2$, respectively. While setting a coating temperature to 38° C., the resulting mixture was coated on the front surface of the substrate by means of an extrusion die coater, thereby to form a coating layer.

Composition of In-Line Solution

| | |
|---|---|
| (1) ALFINE 83 (trade name, manufactured by TAIMEI Chemicals Co., Ltd.) | 2.0 parts |
| (2) Ion exchange water | 7.8 parts |
| (3) HYMAX SC-507 (trade name, dimethylamine-epichlorohydrin polycondensate, manufactured by HYMO Co., Ltd.) | 0.2 parts |

The coating layer formed by the above-described method was dried at 80° C. with a hot-air dryer (air velocity: 3 to 8 m/sec) until the solids concentration therein reached 24%. During this period, the coating layer showed a constant-rate drying speed. Immediately thereafter, the coating layer was immersed for 3 seconds in a solution containing a basic compound and having the following composition, and thereby 13 g/m$^2$ of the solution was deposited on the coating layer surface, and further 10-minute drying at 72° C. was carried out (drying process). Thus, an ink-receiving layer was formed on the substrate.

Composition of Solution Containing Basic Compound

| | |
|---|---|
| (1) Boric acid | 0.65 parts |
| (2) Ammonium carbonate (first grade, manufactured by KANTO CHEMICAL CO., INC.) | 5.0 parts |
| (3) Magnesium chloride (White bittern NS, trade name, manufactured by Naikai Salt Industries CO., LTD) | 0.3 parts |
| (4) Ion exchange water | 88.0 parts |
| (5) Polyoxyethylene lauryl ether (surfactant, EMULGEN 109P, trade name, manufactured by Kao Corporation, 10% aqueous solution, HLB value: 13.6) | 6.0 parts |

In the foregoing manner, inkjet recording medium 1 according to the invention, which had on the substrate the ink-receiving layer having a dry thickness of 35 μm, was produced.

Example 2

Inkjet recording medium 2 was produced in the same manner as in Example 1, except that the addition amount of Surfynol 420 used for production of the coating liquid 1 was changed from 0.07 parts to 0.04 parts.

Example 3

Making of Substrate

A radiofrequency corona discharge treatment was carried out on the front surface of the resin laminated paper obtained by the same manner as in Example 1. Thereafter, a coating liquid for the undercoat layer was applied to the front surface of the resin laminated paper, and then dried. Thereby, substrate 2 having the following undercoat layer formed thereon was produced. Specifically the undercoat layer having the following composition in which the adhesion amount of gelatin is 60 mg/cm$^2$ was formed.

Composition of Undercoat Layer

| | |
|---|---|
| Gelatin | 100 parts |
| A salt of sulfo succinic acid-2-ethylhexylester | 2 parts |
| Chrome alum | 8 parts |

Formation of Ink-Receiving Layer

A coating liquid 2 having the following composition and prepared in the same manner as the coating liquid 1 and the above described in-line solution were subjected to in-line mixing at rates of 206.8 g/m$^2$ and 16.5 g/m$^2$, respectively, and while setting a coating temperature to35° C., the in-line mixture was coated by means of an extrusion die coater on the undercoat layer of the substrate 2 obtained as described above, thereby to form a coating layer. The thus-obtained coating layer was cooled for 20 seconds in a cooling zone kept at 0° C. After the cooling, the coating layer was dried at 80° C. by means of a hot-air dryer (air velocity: 3 to 8 m/sec). Thus, an ink-receiving layer was formed on the substrate, and inkjet recording medium 3 was obtained.

Composition of Coating Liquid 2

| | |
|---|---|
| (1) Vapor-phase process silica fine particles (inorganic fine particles, AEROSIL 300SF75, trade name, manufactured by NIPPON AEROSIL CO., LTD.) | 8.9 parts |
| (2) Ion exchange water | 54.8 parts |
| (3) SHALLOL DC-902P (51.5% aqueous solution, a dispersant, nitrogen-containing organic cationic polymer, manufactured by DAI-ICHI KOGYO SEIYAKU CO., LTD.) | 0.78 parts |
| (4) ZA-30 (trade name, zirconyl acetate manufactured by DAIICHI KIGENSO KAGAKU KOGYO CO., LTD.) | 0.48 parts |
| (5) Methionine sulfoxide (30% aqueous solution, sulfur compound) | 0.88 parts |
| (6) Boric acid (crosslinking agent) | 0.4 parts |
| (7) Polyvinyl alcohol (water-soluble resin) dissolved in liquor | 31.1 parts |

Composition of Polyvinyl Alcohol Dissolved in Liquor

| | |
|---|---|
| PVA235 (trade name, saponification degree: 88%, polymerization degree: 3500, manufactured by KURARAY CO., LTD.) | 2.2 parts |
| Ion exchange water | 28.3 parts |
| Diethylene glycol monobutyl ether (Butycenol 20P, trade name, manufactured by Kyowa Hakko Chemicals Co., Ltd.) | 0.55 parts |

-continued

| | |
|---|---|
| Surfynol 420 (Ethylene oxide adduct of acetylene glycol compound, HLB value 4, Surfactant, trade name, manufactured by Nisshin Chemical Industry Co., Ltd.) | 0.07 parts |
| (8) SUPERFLEX 650 (Nitrogen-containing organic cationic polymer emulsion, trade name, manufactured by DAI-ICHI KOGYO SEIYAKU CO., LTD.) | 1.5 parts |

Example 4

Inkjet recording medium 4 was produced in the same manner as in Example 1, except that the addition amount of Surfynol 420 used for production of the coating liquid 1 was changed from 0.07 parts to 0.09 parts.

Example 5

Inkjet recording medium 5 was produced in the same manner as in Example 1, except that the addition amount of Surfynol 420 used for production of the coating liquid 1 was changed from 0.07 parts to 0.02 parts.

Comparative Example 1

Inkjet recording medium 6 was produced in the same manner as in Example 1, except that the Surfynol 420 used for production of the coating liquid 1 was changed to Surfynol 104 E (acetylene glycol-based surfactant, HLB value 4, trade name, manufactured by Nisshin Chemical Industry Co., Ltd.).

Comparative Example 2

Inkjet recording medium 7 was produced in the same manner as in Example 1, except that the Surfynol 420 used for production of the coating liquid 1 was changed to EMULGEN 109P (Non-acetylene glycol-based surfactant, HLB value 13.6, trade name, manufactured by Kao Corporation).

Comparative Example 3

Inkjet recording medium 8 was produced in the same manner as in Example 1, except that the Surfynol 420 used for production of the coating liquid 1 was changed to Surfynol 465 (Ethylene oxide adduct of acetylene glycol-based surfactant, HLB value 13, trade name, manufactured by Nisshin Chemical Industry Co., Ltd.).

Comparative Example 4

Inkjet recording medium 9 was produced in the same manner as in Example 1, except that the Surfynol 420 used for production of the coating liquid 1 was changed to Surfynol 2502 (Ethylene glycol/propylene glycol adduct of acetylene glycol compound, surfactant, HLB value 8, trade name, manufactured by Nisshin Chemical Industry Co., Ltd.).

Production of Ink

Deionized water was added to the following ingredients to make 1 liter, and stirred for 1 hour while heating at temperature of 30 to 40° C. Next, the pH of the resultant solution was adjusted to 9 with 10 mol/liter of KOH added thereto, and the mixture was filtered under reduced pressure through a 0.25 μm-microfilter to prepare a light magenta ink.

| | |
|---|---|
| Magenta dye represented by the structural formula shown below (Compound M-1): | 7.5 g/L |
| Diethylene glycol: | 50 g/L |
| Urea: | 10 g/L |
| Glycerin: | 200 g/L |
| Triethylene glycol monobutyl ether: | 120 g/L |
| Triethanolamine: | 6.9 g/L |
| Benzotriazole: | 0.08 g/L |
| 2-pyrrolidone: | 20 g/L |

-continued

| | |
|---|---|
| Surfynol 465 (surfactant, trade name, manufactured by Nisshin Chemical Industry Co., Ltd.): | 10.5 g/L |
| PROXEL XL-2 (germicide, trade name, manufactured by ICI Japan,): | 3.5 g/L |

Subsequently, dyes, additives and addition amounts thereof were changed as shown in Table 1 to prepare a magenta ink, a light cyan ink, a cyan ink, an yellow ink and a black ink, and ink set 101 having the composition as shown in Table 1 was prepared.

TABLE 1

(Composition of Ink Set 101)

| | Light Magenta | Magenta | Light Cyan | Cyan | Yellow | Black |
|---|---|---|---|---|---|---|
| Dye (g/L) | Compound M-1 (7.5) | Compound M-1 (30.0) | Compound C-1 (8.75) | Compound C-1 (35.0) | Compound Y-1 (29.0) | Compound Bk-1 (21.5), Compound Bk-2 (5.5) |
| Diethylene glycol (g/L) | 50 | 80 | 170 | 110 | 90 | 10 |
| Urea (g/L) | 10 | 70 | — | — | — | — |
| Glycerin (g/L) | 200 | 150 | 170 | 150 | 150 | 160 |
| Triethylene glycol monobutyl ether (g/L) | 120 | 120 | 130 | 130 | 130 | — |
| Diethylene glycol monobutyl ether (g/L) | — | — | — | — | — | 110 |
| 2-pyrrolidone (g/L) | 20 | — | — | — | — | 50 |
| Surfynol 465 (g/L) | 10.5 | 10 | 9.8 | 10.5 | — | — |
| Surfynol STG (g/L) | — | — | — | — | 8.5 | 9.8 |
| Triethanolamine (g/L) | 6.9 | 7 | 6 | 6 | 0.9 | 15 |
| Benzotriazole (g/L) | 0.08 | 0.07 | 0.08 | 0.08 | — | 0.06 |
| Proxel XL2 (g/L) | 3.5 | 1.5 | 1.1 | 1.2 | 1.5 | 1.1 |

Compound M-1

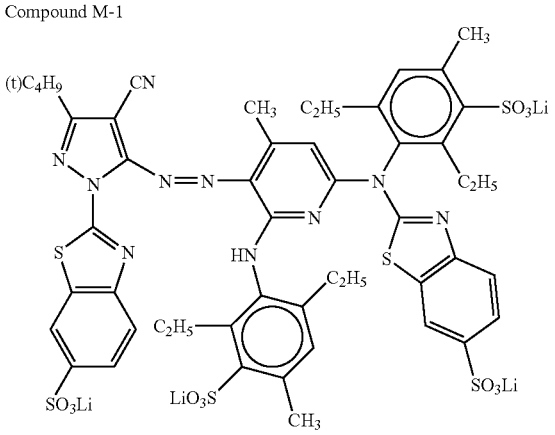

Compound C-1

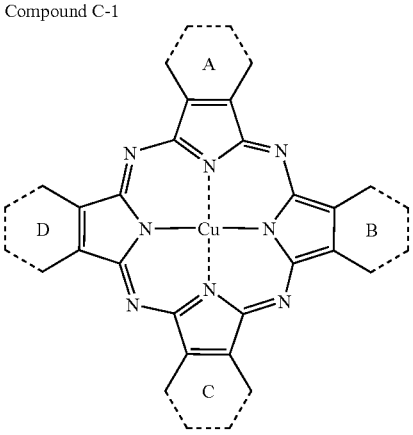

TABLE 1-continued
| (Composition of Ink Set 101) | | | | | | |
|---|---|---|---|---|---|---|
| | Light Magenta | Magenta | Light Cyan | Cyan | Yellow | Black |
One of rings A to D represents:
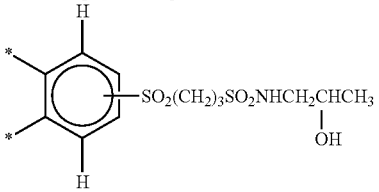
Remaining three rings each represent:
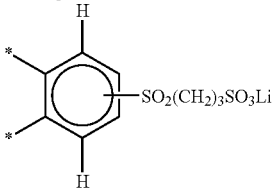
*indicates a bonding site of a phthalocyanine ring.
Compound Y-1
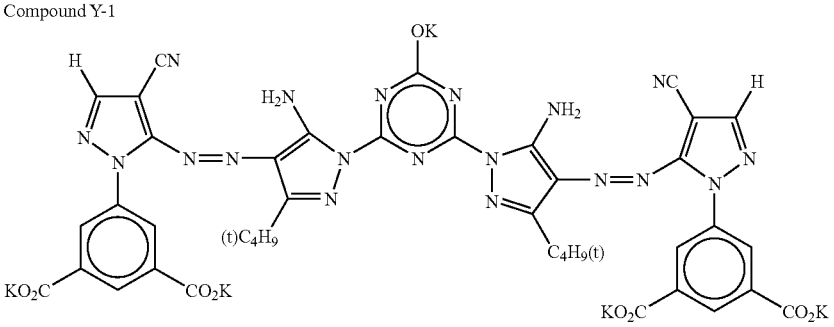
Compound Bk-1
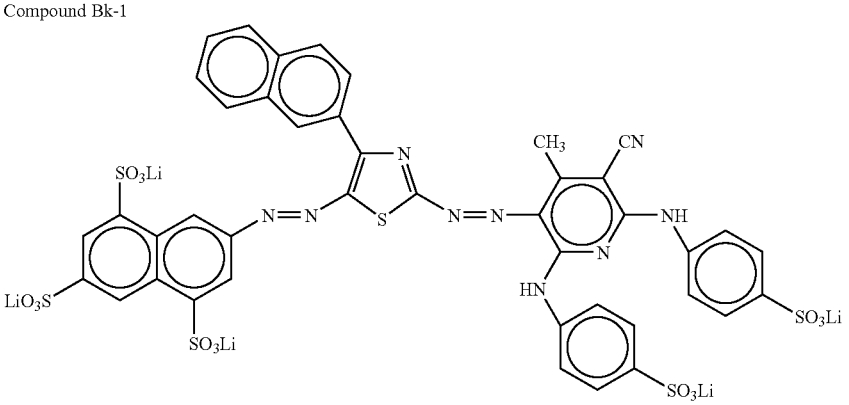
Compound Bk-2
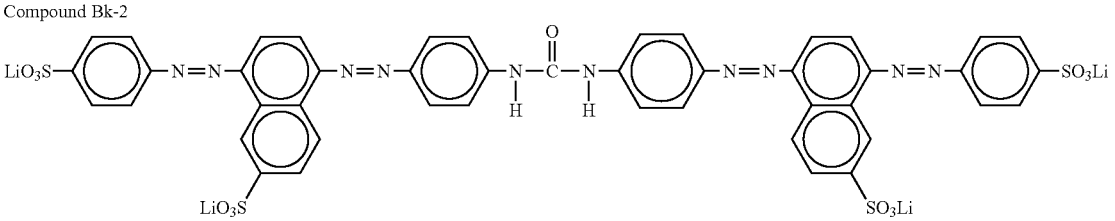

Evaluation

The following evaluations were made on the thus obtained inkjet recording media 1 to 9 using the above-described ink set 101. Evaluation results are shown in Table 2.

Measurement of Print Density

A black solid image was printed using an inkjet printer PM-A820 in which the ink set 101 was installed, and the density of the black portion thus obtained was measured with a reflection densitometer (Xrite 938 manufactured by Xrite Incorporated).

Bleeding

Using an inkjet printer (PIXUS MP950, trade name, manufactured by Canon Inc.) in which the ink set 101 was installed in place of the incorrupt ink set, a grid pattern formed with magenta ink (line width: 0.28 nm) was printed on each inkjet recording medium sample, and stored for 7 days in a chamber kept at a constant temperature of 23° C. and a constant relative humidity of 90%, and bleeding (bleeding with aging) was evaluated on the following criteria.

Evaluation Criteria

A: No bleeding is observed.

B: A bleeding is observed, and yet there is no problem in practice.

C: A bleeding is observed, and there is a problem in practice.

TABLE 2

| | Surfactant | HLB Value | Content ($g/m^2$) in Ink-receiving LAYER | Print density | Bleeding |
|---|---|---|---|---|---|
| Example 1 | Surfynol 420 #1 | 4 | 0.14 | 2.50 | A |
| Example 2 | Surfynol 420 #1 | 4 | 0.08 | 2.55 | A |
| Example 3 | Surfynol 420 #1 | 4 | 0.14 | 2.49 | A |
| Example 4 | Surfynol 420 #1 | 4 | 0.18 | 2.47 | A |
| Example 5 | Surfynol 420 #1 | 4 | 0.03 | 2.54 | A |
| Comparative Example 1 | Surfynol 104E #2 | 4 | 0.14 | 2.40 | A |
| Comparative Example 2 | EMULGEN109P #3 | 13.6 | 0.14 | 2.40 | C |
| Comparative Example 3 | Surfynol 465 #4 | 13 | 0.14 | 2.35 | C |
| Comparative Example 4 | Surfynol 2502 #5 | 8 | 0.14 | 2.40 | B |

#1: Surfynol 420 (Ethylene oxide adduct of acetylene glycol compound)
#2: Surfynol 104E (Acetylene glycol compound)
#3: EMULGEN109P (Non-acetylene glycol compound)
#4: Surfynol 465 (Ethylene oxide adduct of acetylene glycol compound)
#5: Surfynol 2502 (Ethylene oxide/propylene oxide adduct of acetylene glycol compound)

As can be seen from Table 2, it is understood that a high print density can be obtained by using the inkjet recording medium of the invention. In addition, it is understood that occurrence of bleeding with aging even in a high humidity environment can be suppressed by using the inkjet recording medium of the invention.

All publications, patent applications, and technical standards mentioned in this specification are herein incorporated by reference to the same extent as if each individual publication, patent applications, and technical standards was specifically and individually indicated to be incorporated by reference.

What is claimed is:

1. An inkjet recording medium comprising a substrate and, provided on or above the substrate, an ink-receiving layer comprising at least one type of inorganic fine particles, at least one water-soluble resin, and at least one ethylene oxide adduct of an acetylene glycol compound having an HLB value of from 2 to 6, wherein a content of the ethylene oxide adduct of the acetylene glycol compound in the ink-receiving layer is from 0.01 to 0.2 $g/m^2$ and the ethylene oxide adduct of the acetylene glycol compound is a compound represented by the following Formula (1):

Formula (1)

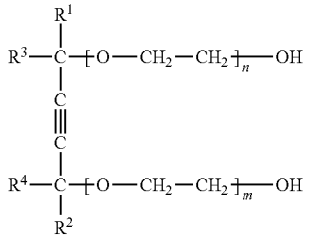

wherein, in Formula (1), each of $R^1$ and $R^2$ independently represents an alkyl group having 1 to 20 carbon atoms; each of $R^3$ and $R^4$ independently represents an alkyl group having 1 to 3 carbon atoms; each of m and n independently represents an integer of 0 to 40, provided that the total of m and n is 1 or more.

2. The inkjet recording medium as claimed in claim 1, wherein the ethylene oxide adduct of the acetylene glycol compound has a structure that is a product of addition of at least one ethylene oxide to an acetylene glycol compound having a carbon-carbon triple bond and two hydroxyl groups in the molecule thereof.

3. The inkjet recording medium as claimed in claim 1, wherein, in Formula (I), each of $R^1$ and $R^2$ is an isobutyl group; each of $R^3$ and $R^4$ is a methyl group; and the total of m and n is 1 or 2.

4. The inkjet recording medium as claimed in claim 1, wherein the content of the ethylene oxide adduct of acetylene glycol compound represented by Formula (I) in the ink-receiving layer is from 0.03 to 0.15 $g/m^2$ and the ethylene oxide adduct of the acetylene glycol compound has an HLB value of from 3 to 5.

5. The inkjet recording medium as claimed in claim 1, wherein the inorganic particles comprise at least one selected from the group consisting of silica fine particles, alumina fine particles and pseudo-boehmite.

6. The inkjet recording medium as claimed in claim 1, wherein the water-soluble resin comprises at least one water-soluble resin selected from polyvinyl alcohol resins, cellulose resins, resins having ether links, resins having carbamoyl groups, gelatins or other resins having carboxyl groups.

7. The inkjet recording medium as claimed in claim 1, wherein the ratio of the inorganic fine particle content (x) by mass to the water-soluble resin content (y) by mass [PB ratio (x/y)] is from 1.5 to 10.

8. The inkjet recording medium as claimed in claim 7, wherein the PB ratio (x/y) is from 2 to 5.

9. The inkjet recording medium as claimed in claim 7, wherein the x/y ratio in an upper-side half of the ink-receiving layer is equal to or higher than the x/y ratio in a lower-side half of the ink-receiving layer.

10. The inkjet recording medium as claimed in claim 1, wherein the ink-receiving layer further comprises a crosslinking agent and is a porous layer formed by hardening the water-soluble resin due to a crosslinking reaction with the crosslinking agent.

11. The inkjet recording medium as claimed in claim 1, wherein the ink-receiving layer further comprises at least one water-soluble multivalent metal compound as a mordant.

12. The inkjet recording medium as claimed in claim 1, wherein the ink-receiving layer further comprises at least one organic nitrogen-containing cationic polymer.

13. The inkjet recording medium as claimed in claim 1, wherein the ink-receiving layer further comprises at least one sulfur-based compound.

* * * * *